US008025163B2

(12) United States Patent
McAllister et al.

(10) Patent No.: US 8,025,163 B2
(45) Date of Patent: Sep. 27, 2011

(54) WALL MOUNTED SHELVING

(75) Inventors: Larry N. McAllister, Dover, DE (US); Eric C. Yocum, Dover, DE (US)

(73) Assignee: Metal Masters Foodservice Equipment Co., Inc., Clayton, DE (US)

( * ) Notice: Subject to any disclaimer, the term of this patent is extended or adjusted under 35 U.S.C. 154(b) by 261 days.

(21) Appl. No.: 12/317,549

(22) Filed: Dec. 22, 2008

(65) Prior Publication Data

US 2010/0155353 A1 Jun. 24, 2010

(51) Int. Cl.
*A47F 5/08* (2006.01)

(52) U.S. Cl. ..... 211/90.03; 211/187; 211/126.9; 108/42

(58) Field of Classification Search ..... 211/186–188, 211/153, 134, 106, 133.5, 181.1, 90.03, 126.9, 211/133.2, 90.01, 90.02, 90.04; 248/250, 248/235, 220.21; D6/566, 574, 570; 108/42, 108/108

See application file for complete search history.

(56) References Cited

U.S. PATENT DOCUMENTS

| | | | | | |
|---|---|---|---|---|---|
| 1,284,235 | A | * | 11/1918 | Carlin | 248/317 |
| 2,081,763 | A | * | 5/1937 | Peterson et al. | 108/30 |
| 2,315,595 | A | * | 4/1943 | Chappory | 211/186 |
| D165,118 | S | * | 11/1951 | Strinning et al. | D6/570 |
| D180,883 | S | * | 8/1957 | Perry | D6/463 |
| 2,951,594 | A | * | 9/1960 | Strinning et al. | 108/96 |
| 3,200,959 | A | * | 8/1965 | Theim | 211/50 |
| 3,294,351 | A | * | 12/1966 | Rollins, Jr. | 248/243 |
| 3,701,325 | A | * | 10/1972 | Fenwick | 108/1 |
| D230,797 | S | * | 3/1974 | Slaboden | D6/570 |
| 3,868,986 | A | * | 3/1975 | Olsen | 164/7.1 |
| 4,191,160 | A | * | 3/1980 | Elliott | 126/9 R |
| 4,732,284 | A | * | 3/1988 | Remmers | 211/188 |
| 4,777,888 | A | * | 10/1988 | Waterman et al. | 108/108 |
| D301,000 | S | * | 5/1989 | Christiansen | D6/570 |
| 5,351,842 | A | * | 10/1994 | Remmers | 211/90.03 |
| 5,592,886 | A | * | 1/1997 | Williams et al. | 108/108 |
| 5,788,093 | A | * | 8/1998 | Krut | 211/119 |
| 5,868,263 | A | * | 2/1999 | McAllister et al. | 211/90.01 |
| D417,108 | S | * | 11/1999 | Von Gunten et al. | D6/511 |
| D418,342 | S | * | 1/2000 | Von Gunten et al. | D6/511 |
| D441,242 | S | * | 5/2001 | Walters-Dowding et al. | D6/566 |
| D445,617 | S | * | 7/2001 | Von Gunten et al. | D6/511 |
| 6,286,691 | B1 | * | 9/2001 | Oberhaus et al. | 211/118 |
| D497,750 | S | * | 11/2004 | Ruffell | D6/515 |
| 6,913,235 | B2 | * | 7/2005 | Oberhaus | 248/250 |
| 6,918,498 | B2 | * | 7/2005 | Sparkowski | 211/187 |
| 7,472,796 | B2 | * | 1/2009 | Dunn | 211/153 |
| 7,703,453 | B2 | * | 4/2010 | Hughes | 126/339 |
| 2004/0016349 | A1 | * | 1/2004 | Robertson | 99/449 |
| 2005/0284828 | A1 | * | 12/2005 | Remmers | 211/94.01 |
| 2006/0145037 | A1 | * | 7/2006 | Sloan | 248/235 |
| 2008/0047916 | A1 | * | 2/2008 | Klingspor et al. | 211/153 |

* cited by examiner

*Primary Examiner* — Darnell M Jayne
*Assistant Examiner* — Devin Barnett
(74) *Attorney, Agent, or Firm* — Connolly Bove Lodge & Hutz LLP

(57) ABSTRACT

A wall mounted shelving unit comprises a pair of shelf supporting wall mounting brackets, each including an upright rear segment and an upright front segment with horizontal crosspieces extending between and connected to the rear and front segments of each bracket. Each crosspiece includes a pair of spaced apart upwardly extending loops or a pair of spaced apart downward extending troughs, and a rear segment of each bracket includes loops for attachment to a wall. Wire shelves rest on the crosspieces, and the upwardly extending loops engage wires on the shelves to prevent relative movement between the shelves and the brackets. Alternatively, the shelf includes downwardly extending shelf trusses that rest in the troughs of the crosspieces.

3 Claims, 7 Drawing Sheets

Fig. 5.
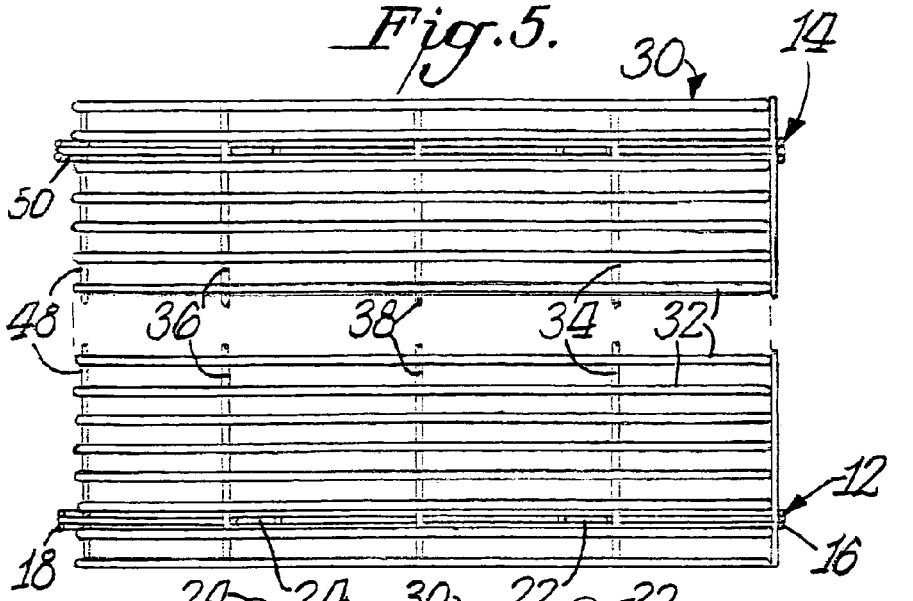
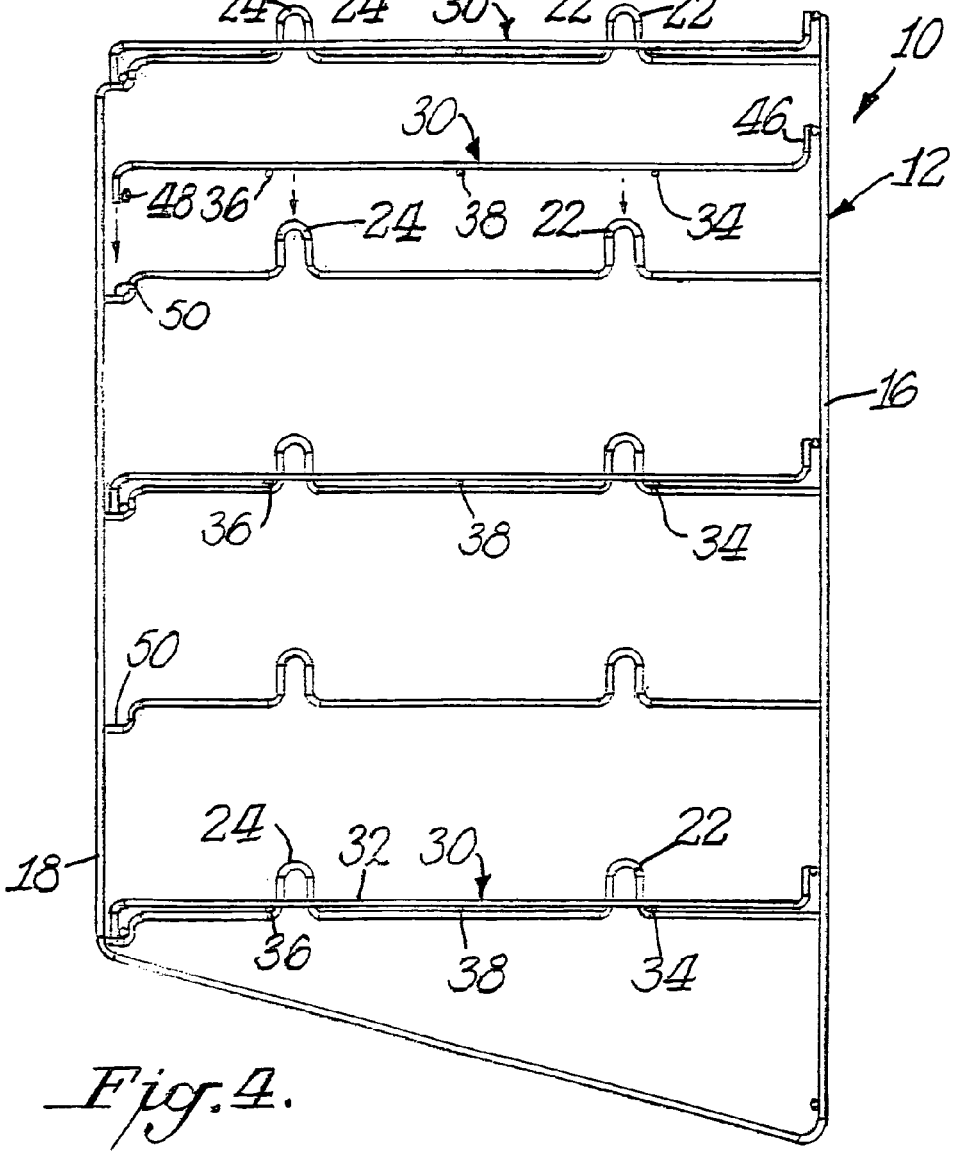
Fig. 4.

WALL MOUNTED SHELVING

BACKGROUND OF THE INVENTION

The present invention relates to a wall mounted shelving unit, and more particularly to a shelving unit with adjustable shelves and adjustable shelf brackets.

Prior to the present invention numerous shelving systems have been developed, but in many instances these systems are difficult to assemble and install due to various conditions of the wall structure to which they are attached. Accordingly, a real need exists for a wall mounted shelving unit which is simple to install under varying conditions of the wall structure to which the unit is attached.

SUMMARY OF THE INVENTION

Accordingly, one of the objects of the present invention is an adjustable wall mounted shelving unit which is easy to assemble and easy to adjust and install.

Another object of the present invention is a wall mounted shelving unit which is easily attached to a wall and conveniently adopted to various wall structures.

Still another object of the present invention is a wall mounted shelving unit which is simple in design, but readily adaptable to varying conditions.

In accordance with the present invention, a wall mounted shelving unit comprises at least a pair of shelf supporting brackets including a right-hand wall bracket and a left-hand wall bracket. Each bracket has an upright rear segment and an upright front segment with at least one horizontal crosspiece extending between and connected to the upright front and rear segments of each bracket.

In one embodiment, each crosspiece has at lest one upright portion to facilitate attachment of a wire shelf spanning the crosspieces on the shelf supporting brackets. Bracket loops on the upright rear segments of the right-hand and left-land wall brackets are provided for attachment to a wall. At least one wire shelf rests on opposing crosspieces with the upright portions of the crosspieces extending upwardly between wires on the shelf. The wire shelf has at least one horizontal wire generally parallel to a wall to which the wire shelving unit is to be attached. In one embodiment of the invention, the horizontal wire is adjacent to and engages the upright portions of the crosspieces forward of the upright portions to thereby prevent forward movement of the shelf relative to the shelf supports. In another embodiment, the horizontal wire is part of a downwardly extending shelf truss which rests within a receiving trough on opposite crosspieces of the brackets.

Preferably, a plurality of vertically spaced apart horizontal crosspieces are provided, each extending between and connected to the upright front and rear segments of each shelf supporting bracket. In one embodiment, at least one upright portion on each crosspiece engages the horizontal wire on the shelf. Preferably, the wall mounted shelving unit includes a plurality of wire shelves resting on the crosspieces, one shelf for each opposing pair of crosspieces on the shelf brackets.

In one embodiment, a second upright portion on each crosspiece is forward of the other upright portion. Each wire shelf has a second horizontal wire parallel to the first and forward of the other horizontal wire. The second horizontal wire is adjacent to and engages the second upright portions of the crosspieces rearward of those upright portions.

In another embodiment, the shelf includes at least two spaced apart downwardly extending shelf trusses parallel to each other and the wall to which the wire shelving unit is to be attached. In turn, the crosspieces each include two spaced apart troughs for receiving the trusses.

Preferably, the upright portions on the crosspieces of one embodiment each comprises an upwardly extending loop. Additionally, the rear segment of each shelf bracket includes a pair of vertically spaced part bracket loops for attachment to the wall. In one embodiment, the bracket loops on the rear segment of the right-hand wall bracket inwardly extend toward the left-hand wall bracket while the bracket loops on the rear segment of the left-hand wall bracket inwardly extend toward the right-hand bracket. In another embodiment, both brackets are identical, and the bracket loops on each bracket extend to the left.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which:

FIG. 4 is a right side elevational view of the wall mounted shelving unit shown in FIGS. 1 and 2 with three attached shelves and one shelf positioned for placement of the right-hand shelf bracket;

FIG. 5 is a top plan view of the wall mounted shelving unit shown in FIG. 4;

DETAILED DESCRIPTION OF THE INVENTION

Figure 1:
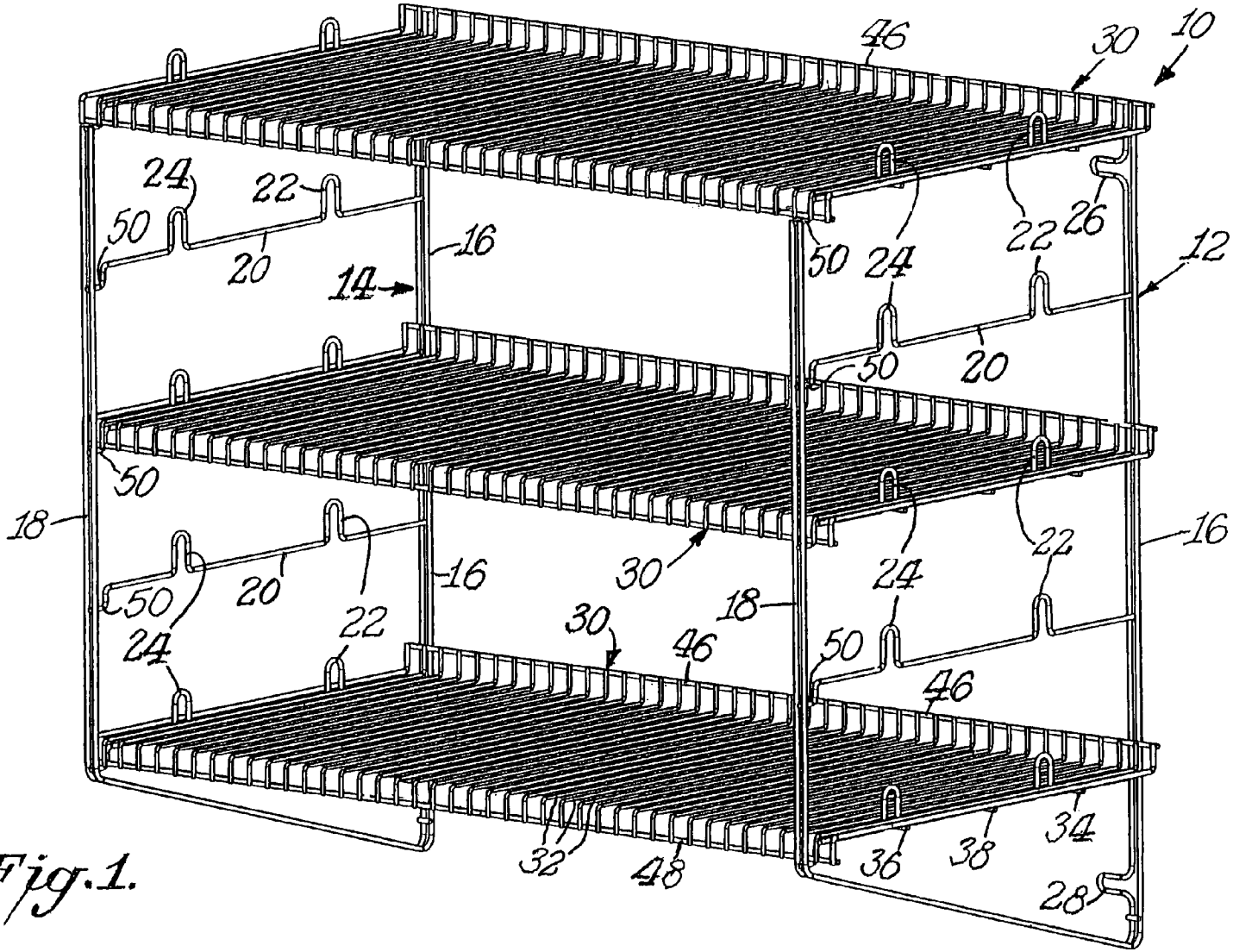
FIG. 1 is a perspective view of wall mounted shelving unit comprising right-hand and left-hand shelf supporting brackets and wire shelving, according to the present invention.

Referring in more particularity to the drawings, FIG. 1 shows a wall mounted shelving unit 10 comprising a pair of shelf supporting wall mounted brackets 12, 14 including a right-hand wall bracket 12 and a left-hand wall bracket 14. Each wall bracket has an upright rear segment 16 and an upright front segment 18 with vertically spaced apart horizontal crosspieces 20 extending between and connected to the upright rear and front segments 16, 18 of each bracket 12, 14. Horizontal spaced apart upwardly extending loops 22, 24 are provided on each crosspiece, 20, for reasons explained more fully below. Also, an upper bracket loop 26 and a lower bracket loop 28, inwardly extend on the upright rear segments 16 of the right-hand and left-hand wall brackets 12, 14 to facilitate attachment of the brackets to the wall, as explained more fully below.

A wire shelf 30 is supported on each opposing pair of crosspieces 20 with the back and front loops 22, 24 of the crosspieces extending upwardly between adjacent front-to-back wires 32 on the shelf. Each wire shelf includes at least two spaced apart horizontal wires including a rear horizontal wire 34 and a front horizontal wire 36, both wires being generally parallel to the wall structure to which the wire shelving unit 10 is to be attached. The rear horizontal wire 34 is adjacent to and engages the back loop 22 of each crosspiece 20, and the back loop is positioned in front of the rear horizontal wire which prevents forward movement of the wire shelf 30 relative to the shelf supporting brackets 12, 14. Additionally, the front horizontal wire 36 is adjacent to and engages the front loop 24 on each crosspiece 20, and the front loop 24 is positioned behind the front horizontal wire 36. The wire shelf 30 may include additional horizontal wires such as the middle horizontal wire 38.

With the back loop 22 of each crosspiece 20 positioned in front of the rear horizontal wire 34 and the front loop 24 of each crosspiece 20 positioned behind the front horizontal wire 36, the wire shelving is locked in place on the crosspieces 20 of the shelf supporting brackets 12, 14. Such positioning prevents both forward and rearward movement of each wire shelf relative to the shelf supporting brackets.

Figures 2, 3:
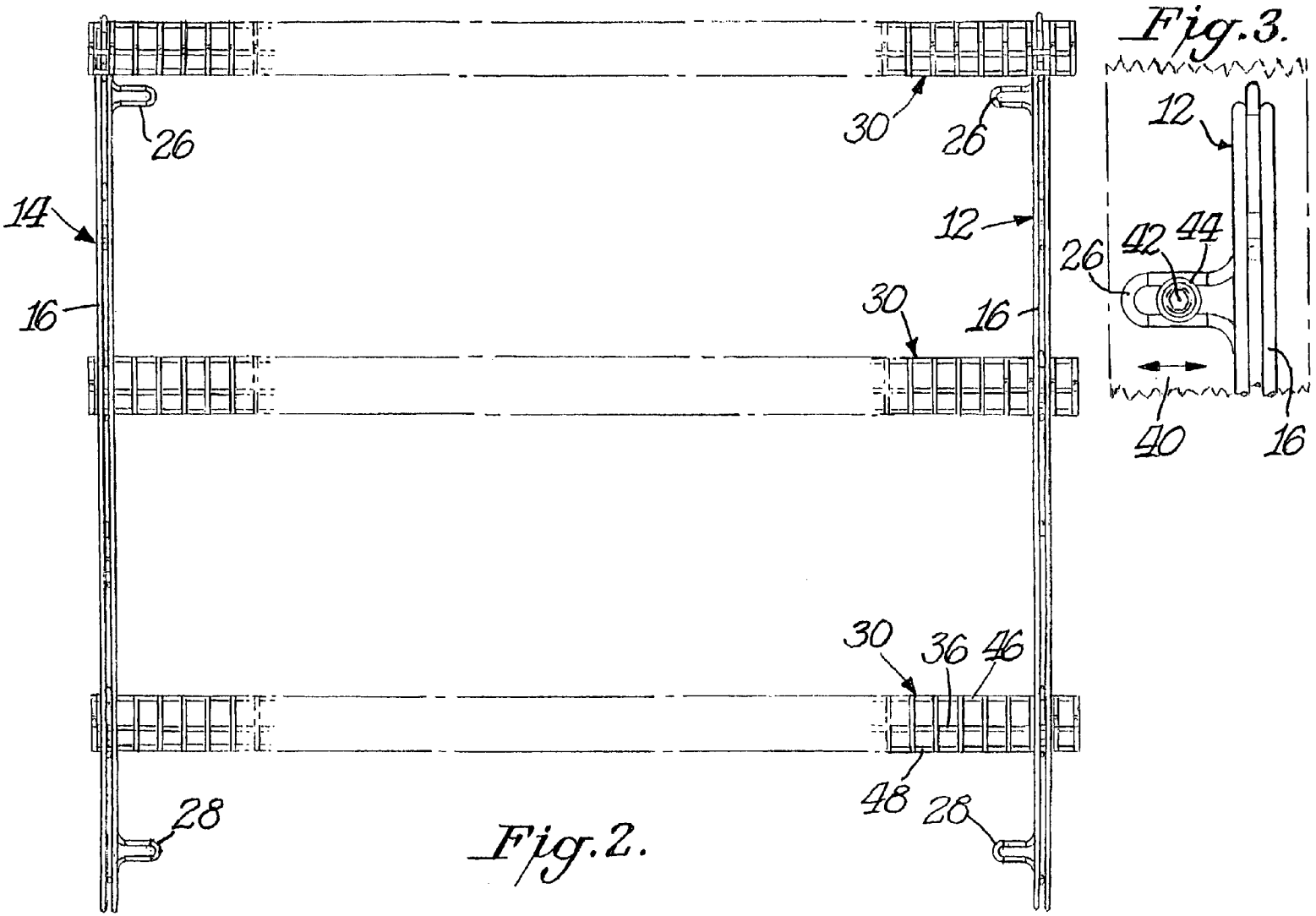
FIG. 2 is a front elevational view of the wall mounted shelving unit shown in FIG. 1.
FIG. 3 is a fragmental front elevational view of the right-hand shelf supporting bracket with one of the bracket loops thereof attached to a wall stud.
Figure 6:
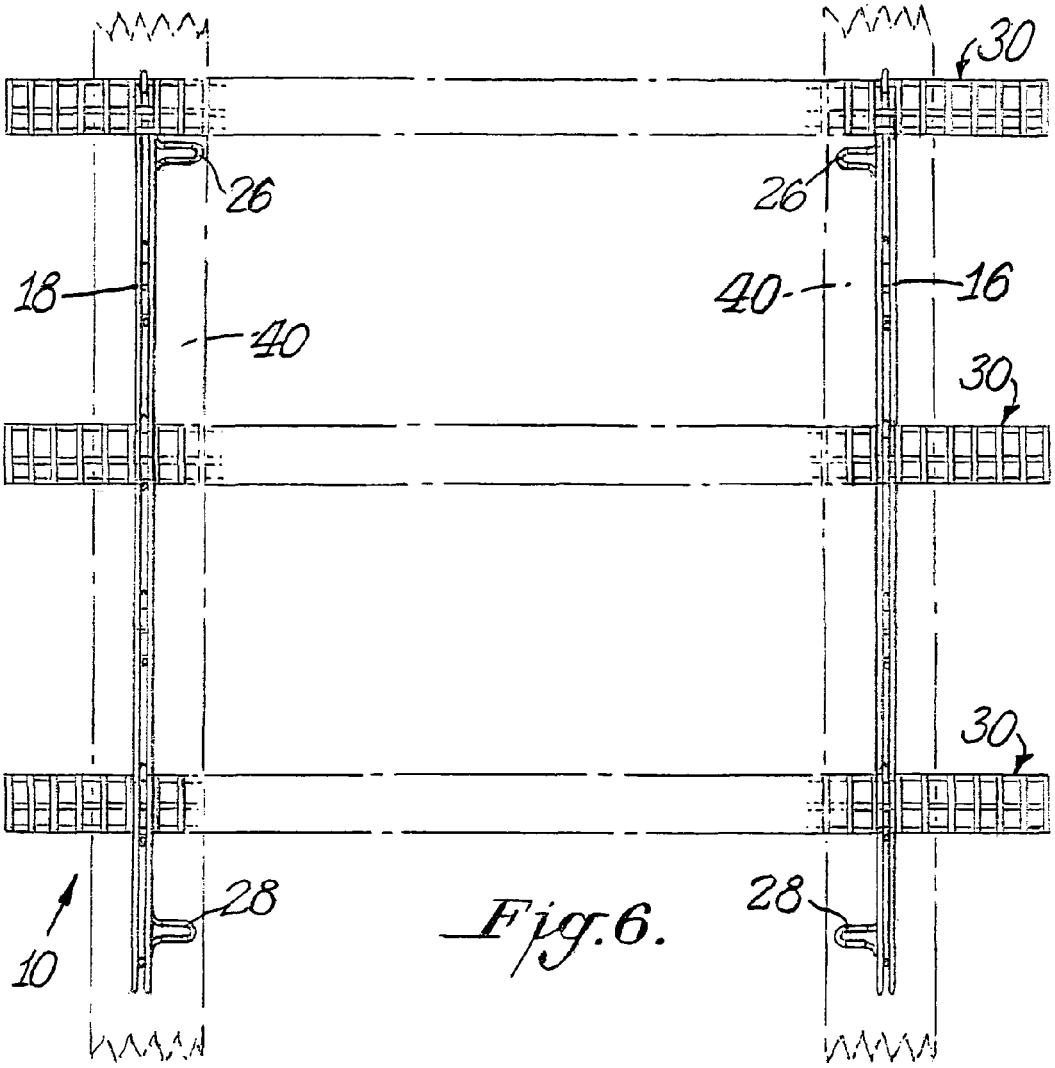
FIG. 6 is a front elevational view of the wall mounted shelving unit with the right-hand and left-hand shelf supporting brackets located on existing studs and the shelves horizontally adjustable relative to the brackets.
Figure 9:
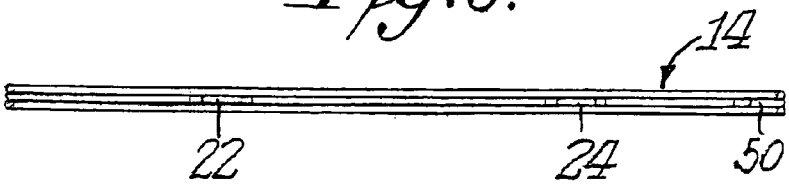
FIG. 9 is a top plan view of the left hand shelf supporting bracket show in FIG. 7.
Figure 7:
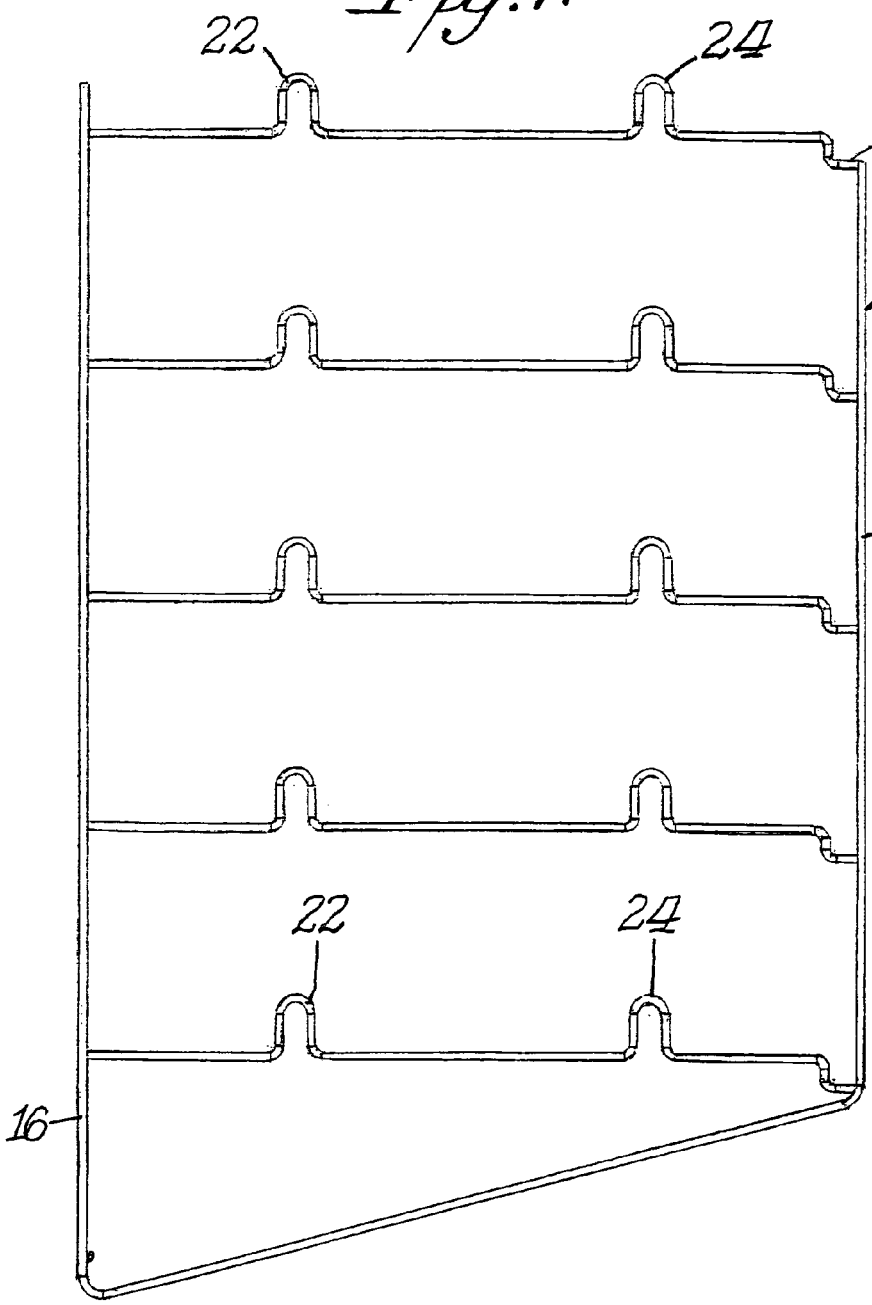
FIG. 7 is a left side elevational view of the left-hand shelf supporting bracket.
Figure 8:
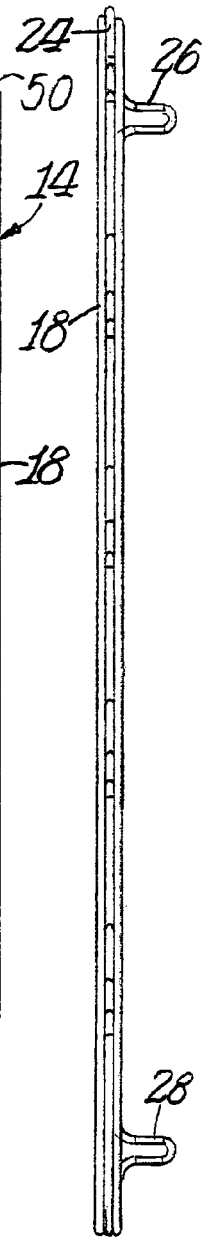
FIG. 8 is a front elevational view of the left-hand shelf supporting bracket shown in FIG. 7.

FIG. 3 illustrates the manner in which the upper and lower bracket loops 26, 28 are secured to the studs 40 of a vertical wall. Lag bolts 42 with washers 44 extend through the loops 26, 28 and into threaded engagement with the studs 40. Regardless of the spacing between the rear segments 16 of the shelf supporting brackets 12, 14, which is determined by the stud locations in the wall, the wire shelves 30 rest upon the crosspieces 20, and the back and front loops 22, 24 on the crosspieces 20 extend upwardly between any adjacent pair of the front-to-back wires 32 of the shelf 30. This provides significant adjustability of attachment of the shelves 30 to the brackets 12, 14 and renders less critical where the brackets are secured to the studs 40. The spacing between the rear segments 16 of the brackets 12, 14 is also less critical.

As shown in FIG. 2, for example, the upper and lower bracket loops 26, 28 on the rear segment 16 of the right-hand shelf supporting bracket 12 inwardly extend toward the left-hand shelf supporting bracket 14 while the bracket loops 26, 28 on the rear segment 16 of the left-hand shelf supporting bracket inwardly extend toward the right-hand shelf supporting bracket 12. This orientation of the upper and lower bracket loops 26, 28 enables a solid and superior attachment of the shelving unit to the studs 40 of the wall to which the shelving unit is attached.

Both the shelf supporting brackets 12, 14 and the wire shelf 30 are fabricated from metal wire by techniques known in the art which includes spot welding of the wires where they contact one another. Normally each wire shelf includes a rear upturned portion 46 and a front downturned portion 48, as shown in FIG. 1, for example. Preferably, the front of each crosspiece 20 slightly drops before connection to the front segment 18 of each shelf supporting bracket 12, 14, to thereby form a recess or trough 50 which receives the front downturned portion 48 of the shelf 30. Hence, the shelf 30 is supported by engaging the length of the crosspiece and also through engagement of the front downturned portion 48 within the recess 50.

Figure 10:
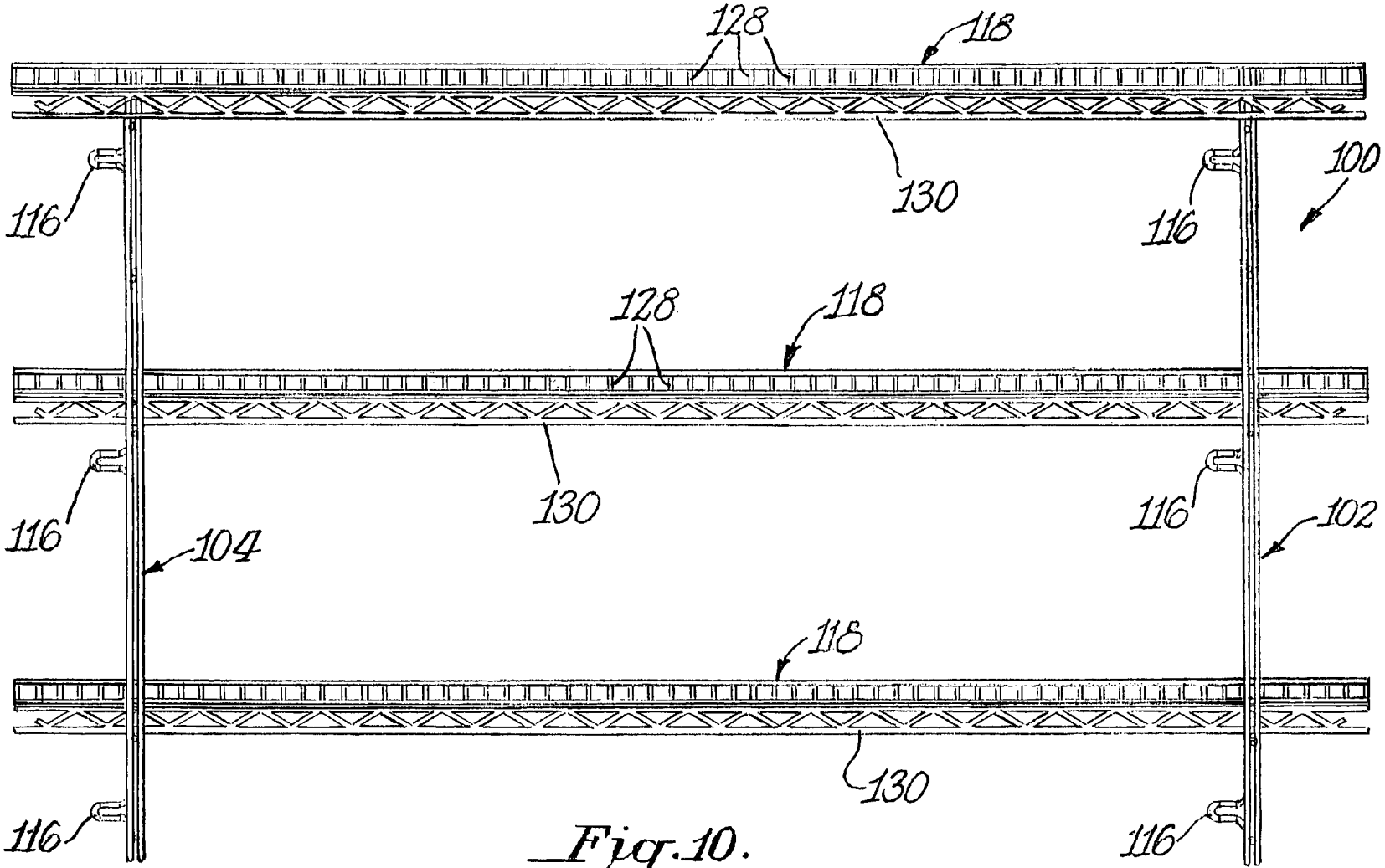
FIG. 10 is a front elevational view of another wall mounted shelving unit comprising identical left and right shelf supporting brackets and wire shelving, according to the present invention.
Figure 11:
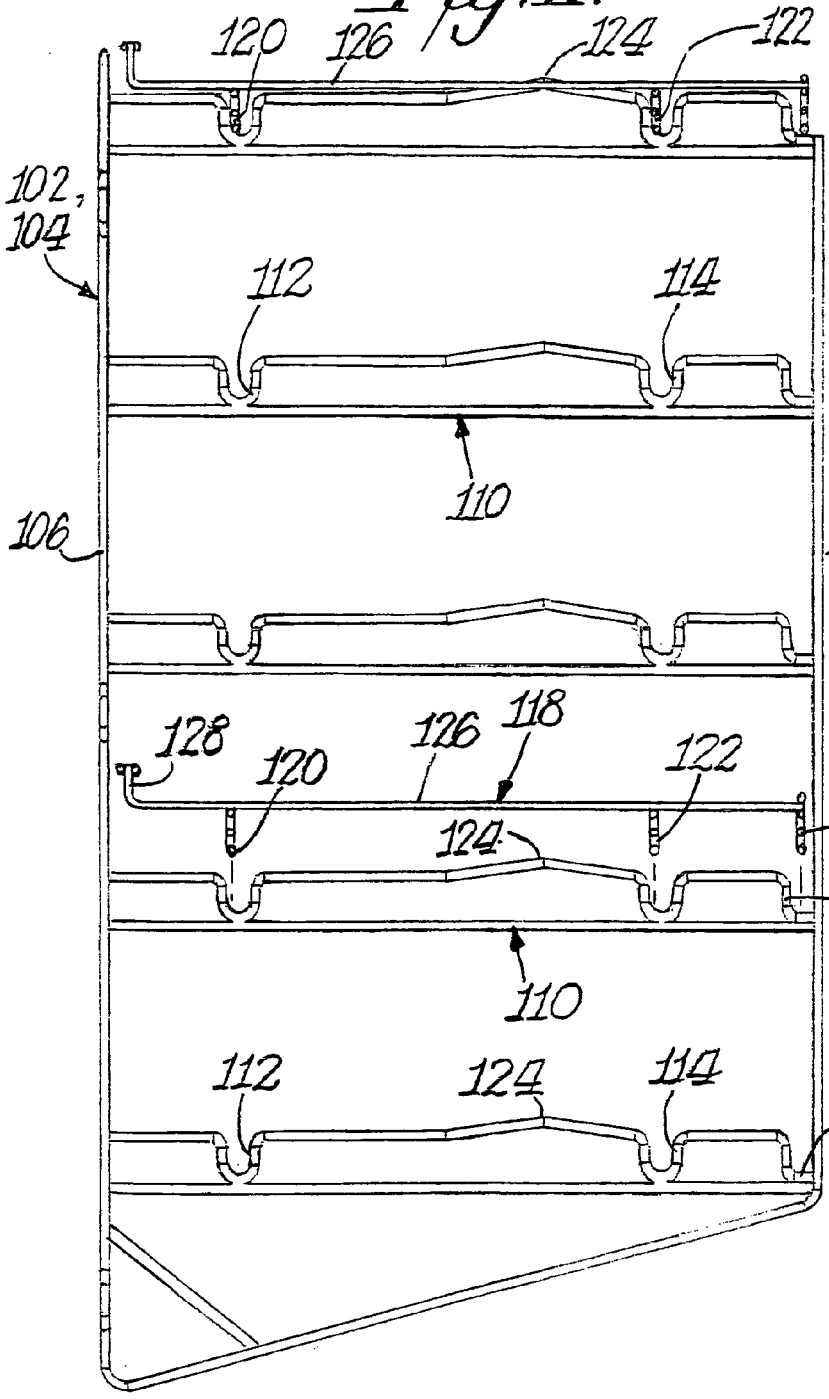
FIG. 11 is a left side elevational view of one of the shelf supporting brackets.
Figure 12:
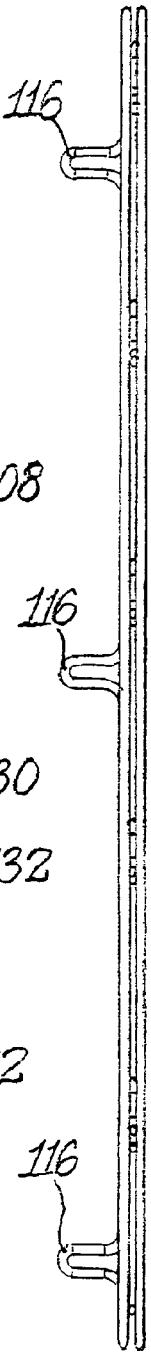
FIG. 12 is a front elevational view of the shelf supporting bracket shown in FIG. 11.

FIGS. 10-12 show a modified wall mounted shelving unit 100 comprising a pair of shelf supporting wall mounted brackets 102, 104. Brackets 102, 104 are identical in construction and each includes an upright rear segment 106 and an upright front segment 108 with vertically spaced apart horizontal crosspieces 110 extending between and connected to the upright rear and front segments 106, 108 of each bracket 102, 104.

As shown best in FIG. 11, each crosspiece 110 includes a pair of spaced apart troughs 112, 114, for reasons explained more fully below. Also, three vertically spaced apart bracket loops 116 extend outwardly to the left on the rear segment 106 of each bracket 102, 104 to facilitate attachment of the brackets to the studs of a wall to which the shelving unit 100 is to be attached. Lag bolts 42 and washers 44 are used for the attachment in the same manner as shown in FIG. 3.

A wire shelf 118 is supported on each opposing pair of crosspieces 110, and in this regard the wire shelf includes a pair of spaced apart downward extending shelf supporting trusses 120, 122. The trusses are parallel to the wall to which the shelving unit 100 is to be attached, and the spacing between them is the same as spacing between the troughs 112, 114 on the crosspiece 110. The shelf supporting trusses 120, 122 are received within the troughs 112, 114 for supporting the shelf 118 in place and preventing it from movement in a forward or rearward direction relative to the crosspiece.

Each crosspiece 110 also includes an upwardly bent portion 124 which extends upwardly between the parallel wires 126 of shelf 118 to thereby prevent movement of the shelf to the left or right relative to the crosspiece.

Each shelf 118 may further include a rearward upturned portion 128 which prevents rearward movement of items placed on the shelf. Additionally, the front of the shelf 118 may include a front shelf supporting truss 130 which rests within a downturned portion 132 or trough on the crosspiece 110. As in the case of trusses 120, 122, the front truss 130 rests on the crosspiece 110 for support of the front areas of the shelf.

Both the shelf supporting brackets 102, 104 and the wire shelf 118 are fabricated from metal wire by steps known in the art which includes spot welding of the wires where they contact one another.

What is claimed is:

1. A wall mounted shelving unit comprising at least a pair of shelf supporting wall mounting brackets including a right-hand wall bracket and a left-hand wall bracket, each wall bracket having an upright rear segment and an upright front segment with a plurality of vertically spaced apart horizontal crosspieces extending between and connected to the upright front and rear segments of each bracket, the plurality of horizontal crosspieces each having a first and a second upright portion, the second upright portion on each crosspiece spaced apart and forward of the first upright portion, a plurality of wire shelves resting on opposing crosspieces with each upright portion extending substantially vertically and upwardly between wires of the shelves, the wire shelves each including a front downturned portion, wherein each crosspiece includes a recess constructed and arranged to receive the downturned portion of each of the shelves, the wire shelves each having a first horizontal wire generally parallel to a wall to which the wire shelving unit is to be attached adjacent to and engaging the first upright portion of the crosspieces and rearward of the first upright portion to thereby prevent forward movement of the plurality of shelves relative to the shelf brackets, the wire shelves each having a second horizontal wire generally parallel to a wall to which the wire shelving unit is to be attached spaced apart and forward from the first horizontal wire adjacent to and engaging the second upright portion of the crosspieces and forward of the second upright portion, wherein the upright portions on each crosspiece comprise an upwardly extending loop.

2. A wire shelving unit as in claim 1 wherein the rear segment of each shelf supporting bracket includes a pair of vertically spaced apart bracket loops for attachment to a wall.

3. A wire shelving unit as in claim 2 wherein the bracket loops on the rear segment of the right-hand bracket inwardly extend toward the left-hand bracket and the bracket loops on the rear segment of the left-hand wall bracket inwardly extend toward the right-hand bracket.

* * * * *